US007571587B2

(12) United States Patent
Goodman

(10) Patent No.: US 7,571,587 B2
(45) Date of Patent: Aug. 11, 2009

(54) FLAPS CLOSER APPARATUS

(75) Inventor: James A. Goodman, Glencoe, IL (US)

(73) Assignee: Prototype Equipment Corporation, Waukegan, IL (US)

( * ) Notice: Subject to any disclaimer, the term of this patent is extended or adjusted under 35 U.S.C. 154(b) by 0 days.

(21) Appl. No.: 11/803,302

(22) Filed: May 14, 2007

(65) Prior Publication Data

US 2007/0214751 A1 Sep. 20, 2007

Related U.S. Application Data

(63) Continuation of application No. 10/976,608, filed on Oct. 29, 2004, now Pat. No. 7,216,468.

(60) Provisional application No. 60/516,016, filed on Oct. 31, 2003.

(51) Int. Cl.

| | |
|---|---|
| ***B65B 7/10*** | (2006.01) |
| ***B65B 51/14*** | (2006.01) |
| ***B31B 1/48*** | (2006.01) |

(52) U.S. Cl. ..... 53/377.3; 53/376.4; 493/183

(58) Field of Classification Search ..... 53/491, 53/484, 376.3, 376.4, 376.5, 377.3, 377.4, 53/377.11, 377.6, 378.3, 387.1; 493/183
See application file for complete search history.

(56) References Cited

U.S. PATENT DOCUMENTS

| | | | | |
|---|---|---|---|---|
| 3,397,509 | A * | 8/1968 | Ullman | 53/285 |
| 4,524,560 | A * | 6/1985 | Goodman | 53/377.3 |
| 4,673,381 | A * | 6/1987 | Yamamoto et al. | 493/128 |

* cited by examiner

*Primary Examiner*—Paul R Durand
(74) *Attorney, Agent, or Firm*—Valauskas & Pine LLC

(57) ABSTRACT

A flaps closing apparatus for closing full flap boxes is provided. The apparatus includes a flaps closing assembly with a first brake mechanism and closing bars with a second brake mechanism. The first brake mechanism controls the vertical motion of the flaps closing assembly with respect to the flaps closing apparatus. The second brake mechanism holds the closing bars in an angled configuration and at a first predetermined vertical position permits the bars to pivot to a horizontal configuration. A flap sealing assembly includes a pair of compression plates positioned outside the flaps closing assembly. A compression plate actuating mechanism draws the compression plates inwardly to urge side flaps of the full flap box into contact with sides of the full flap box at a second predetermined vertical position. A vertical movement mechanism lowers and raises the apparatus.

10 Claims, 8 Drawing Sheets

FLAPS CLOSER APPARATUS

This application is a continuation of application Ser. No. 10/976,608 , filed Oct. 29, 2004 , now U.S. Pat. No. 7,216, 468, which claims the benefit of U.S. Provisional Application No. 60/516,016, filed Oct. 31, 2003.

FIELD OF THE INVENTION

This invention relates generally to an apparatus for handling boxes or cartons, and more particularly to an apparatus for automatically closing and permitting the sealing of the flaps of a container. The invention is particularly applicable to the closing and sealing of boxes that have been previously packed with products and is quickly and accurately adaptable to closing different sized boxes.

BACKGROUND OF THE INVENTION

Packaging systems are an important aspect of manufacturing. A significant expense in manufacturing is the erecting a box from a blank, packing the box with product, and sealing the box after filling. Containers include, for example, boxes, cartons and similar packages made of paper, cardboard and similar materials. Until recent times, human hands have performed the tasks of assembling and packing containers.

While box-sealing mechanisms are well known in the art, the ability to change a packaging line to seal a different type or sized carton often requires the shutting down of the packaging line to adapt the sealing machinery to the new carton. This adaptation not only causes a pause in production, but may require both the time and expense of mechanics changing over the machinery and attaching different packaging machinery parts. In such a case, space is needed to store the different packaging machine parts and a system to keep track of the parts needed for various sized boxes, and adding to the overall cost of the packaging system.

Increasingly, automated systems are being developed to reduce the human and material resources needed to assemble, pack and seal different containers as well as reduce the time needed for adaptation to different packaging operations. It is well known that containers are available in a wide range of configurations, each configuration having specific closing and sealing requirements. For example, the Regular Slotted Container (RSC) has four flaps on the bottom and an identical number of flaps on the top, namely a pair of opposed minor flaps alternating with a pair of opposed major flaps. Numerous methods have been proposed which are used to seal RSC boxes.

Typically, the erecting and sealing of a regular slotted container proceeds along the following lines. A blank is assembled into a box-like configuration and glue is applied to specified surfaces of the bottom flaps. The bottom flaps are then folded and held in that position until the glue is set. This process can be carried out either manually or by machine and is not overly difficult since the case is empty at this stage and pressure can be applied from above and below so as to sandwich the bottom flaps in the closed position until it is assured that the glue is set. Machines specially adapted for erecting a folded blank into a box configuration, applying glue to the bottom flaps and folding the same, are known in the art.

As discussed above, the filling or packing of cases can be performed manually or, increasingly by mechanical means. Robotic packing machines are increasingly being used to fill cases with product.

The process of closing the case top is, however, not as easily accomplished. Equipment access from inside the erected case, to hold the top flaps sandwiched together in a closed position, is precluded. If the contents fill the erected case to the top, and if such contents are solid, external pressure from above alone may be effective to press the top flaps against such contents until the glue is sufficiently dried. Such an unpredictable arrangement is unacceptable for high-speed commercial sealing operations. Without predictable supporting during the gluing operations, the top flaps cannot be sealed effectively in that fashion. Machines specially adapted for closing case tops for RSC cases are exemplified by machinery described in for example, U.S. Pat. No. 4,524,560.

Of course, different cases require different sealing strategies. Full flap or side sealed boxes, i.e., those cases having two top flaps with end portions which are glued to the sides of the box cannot be effectively closed using exactly the same case sealing mechanism as a RSC box. What is required is a mechanism that urges the two top flaps into a horizontal position and then urges the four end portions of the two top flaps into a vertical position against the pre-glued sides of the box.

There is a demand therefore for a mechanism that efficiently closes side seal boxes and is easily and quickly adaptable to different sized containers. The present invention satisfies the demand.

SUMMARY OF THE INVENTION

The present invention has a principal objective of providing a device and method of closing a full flap box in an efficient manner. Broadly stated, this is accomplished by a flap closing apparatus having two main parts. The flaps closing apparatus of the present invention generally includes a flaps closing assembly, which lowers upon and closes the top of a full flap box by urging the pair of top flaps from a vertical position into a horizontal position to cover a top opening of the box. In the alternate, the box may be raised to come into operational contact with the flap closing apparatus.

A compression plate assembly, including a pair of vertical compression plates attached to bars is drawn inwardly, preferably in an arc, to urge the glue flaps of the box into a vertical position, whereby the glue flaps are pressed into contact with the sides of the box and may be affixed to the sides of the box to seal the box in a closed condition.

It will be understood that the present invention may be incorporated into a unitary system with box-forming, packing and box sealing capabilities as a subsystem thereof, or alternately, may be provided as a stand alone unit. Of course, regardless of how the invention is applied to a packaging/packing system, it will be understood that boxes packed with product will be conveyed to the flaps closer assembly in such a condition and orientation so that the closer assembly is permitted to receive open boxes, close the boxes, which closed boxes are then conveyed out of the closer assembly.

These and other advantages, as well as the invention itself, will become further apparent in the details of construction and operation as more fully described below. Moreover, it should be appreciated that several aspects of the invention can be used in other applications where non-wood combustibles are used.

DETAILED DESCRIPTION OF PRESENTLY PREFERRED EMBODIMENTS

Figure 1:
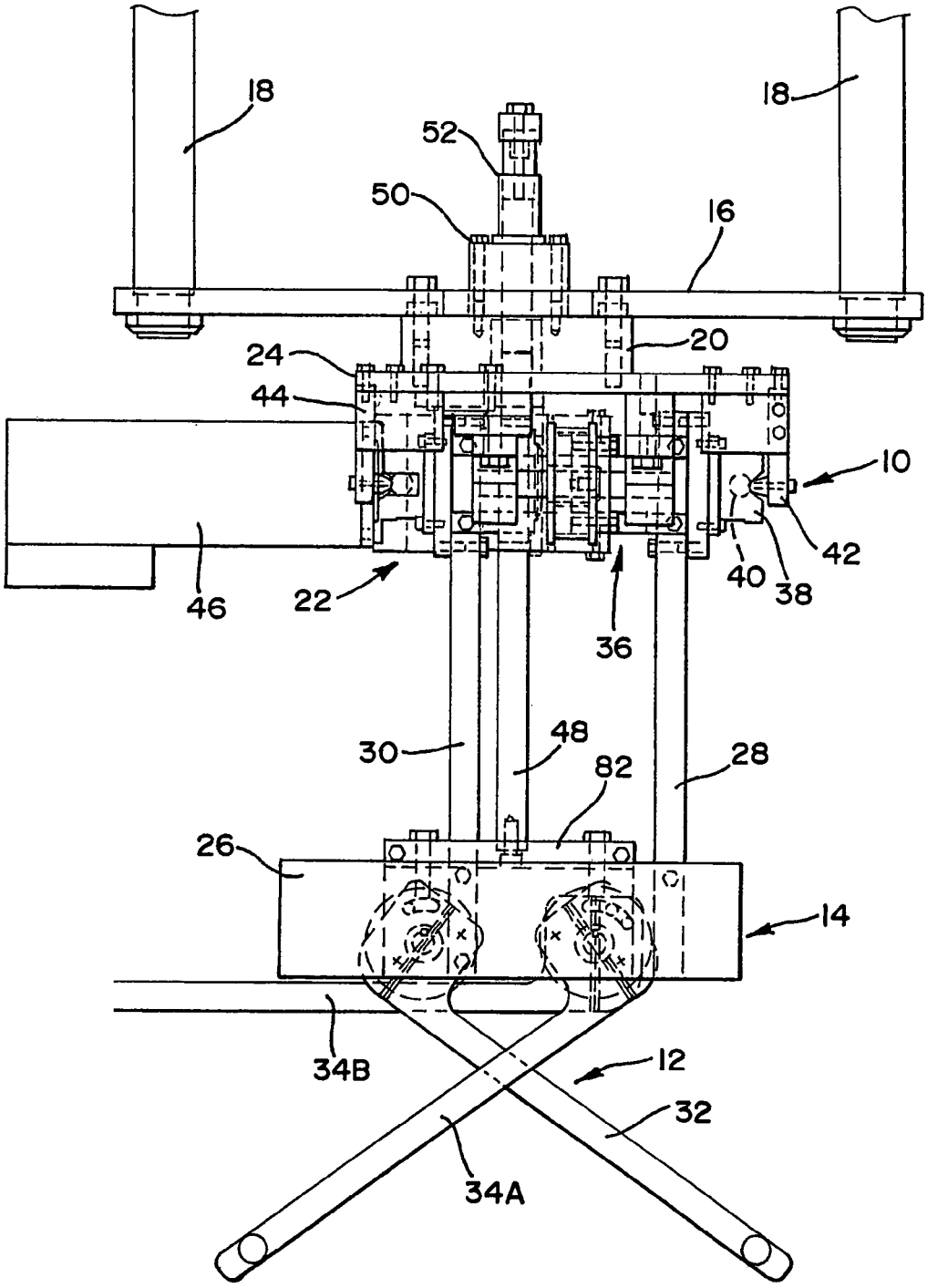
FIG. 1 is a side view of the flaps closer assembly in accordance with the present invention.

FIG. 1 shows a side view of one embodiment of the present invention. It will be understood that reference to elements of the apparatus, and description of relative positions thereof, will be given according to their orientation depicted in the drawings and are not intended to be limiting. Identical parts of the apparatus are labeled with the same reference characters in the figures. Also, for purposes of orientation, it will be understood that pre-packed boxes, having glue previously applied to opposing sides travel from left to right in FIG. 1, by way of any conveyance known in the art, such as a conveyor belt or rollers, for example. A full flap box will be used in the following illustrations of the operation of the invention. A full flap box includes a pair of top flaps. The top flaps extend across a top opening of the erected box, each of the flaps covering half of the opening. The flaps also extend past opposite ends of the box to form (four) tab-shaped extensions, which when folded into a vertical position into contact with the sides of the box, become affixed (preferably glued) thereto, sealing the box in a closed condition.

The flaps closing apparatus of the present invention is generally shown at 10, and includes two main box-closing portions. Briefly, a flaps closing assembly 12 preferably lowers upon and closes the top of a full flap box by urging the pair of top flaps from a vertical position into a horizontal position to cover a top opening of the box. In effect, the same result can be accomplished by raising the box to the assembly 12 in contrast to lowering the assembly onto the box. However, the former method of operation is preferred.

Compression plate assembly 14, including a pair of compression plates 26, being attached to bars 28, 30 is lowered and drawn inwardly, preferably in an arc, to urge glue flaps of the box into a vertical position, whereby the glue flaps are pressed into contact with the sides of the box and may be affixed to the sides of the box to seal the box in a closed condition.

Figure 7:
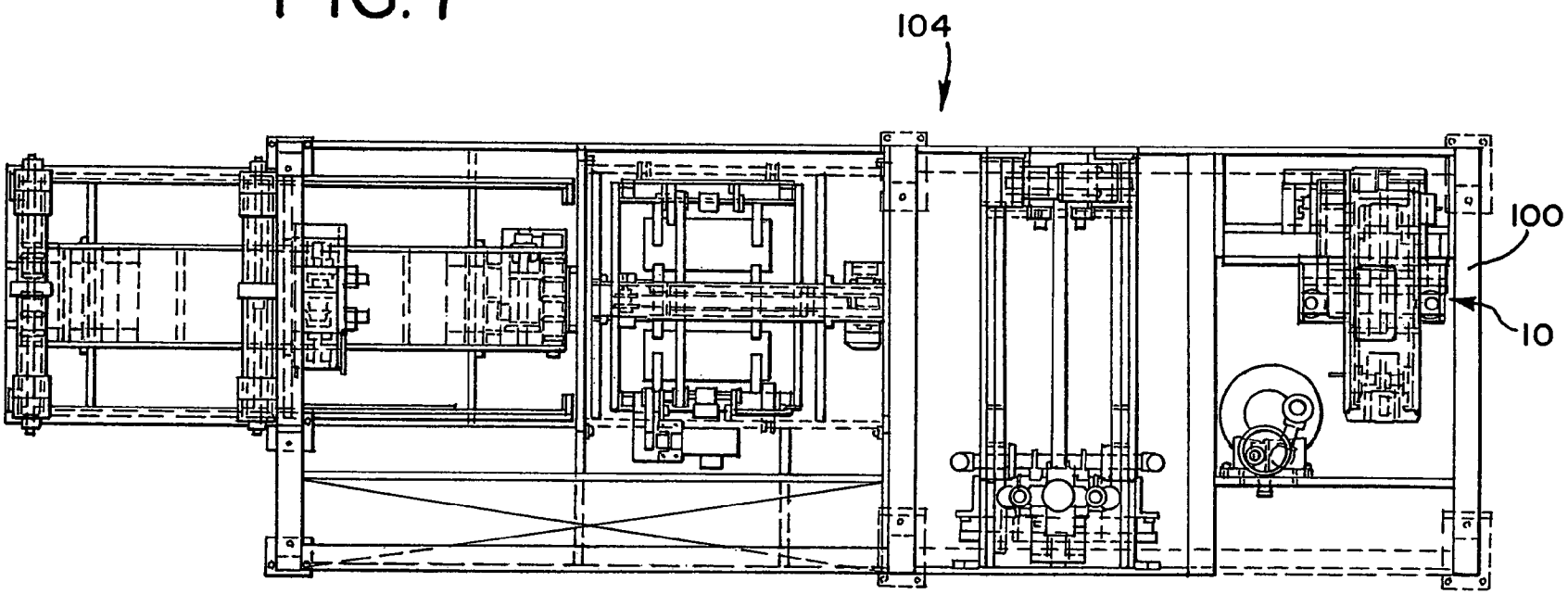
FIGS. 7-9 are top, side and end views, respectively, of an integrated packaging system including an embodiment of the device according to the present invention.
Figure 8:
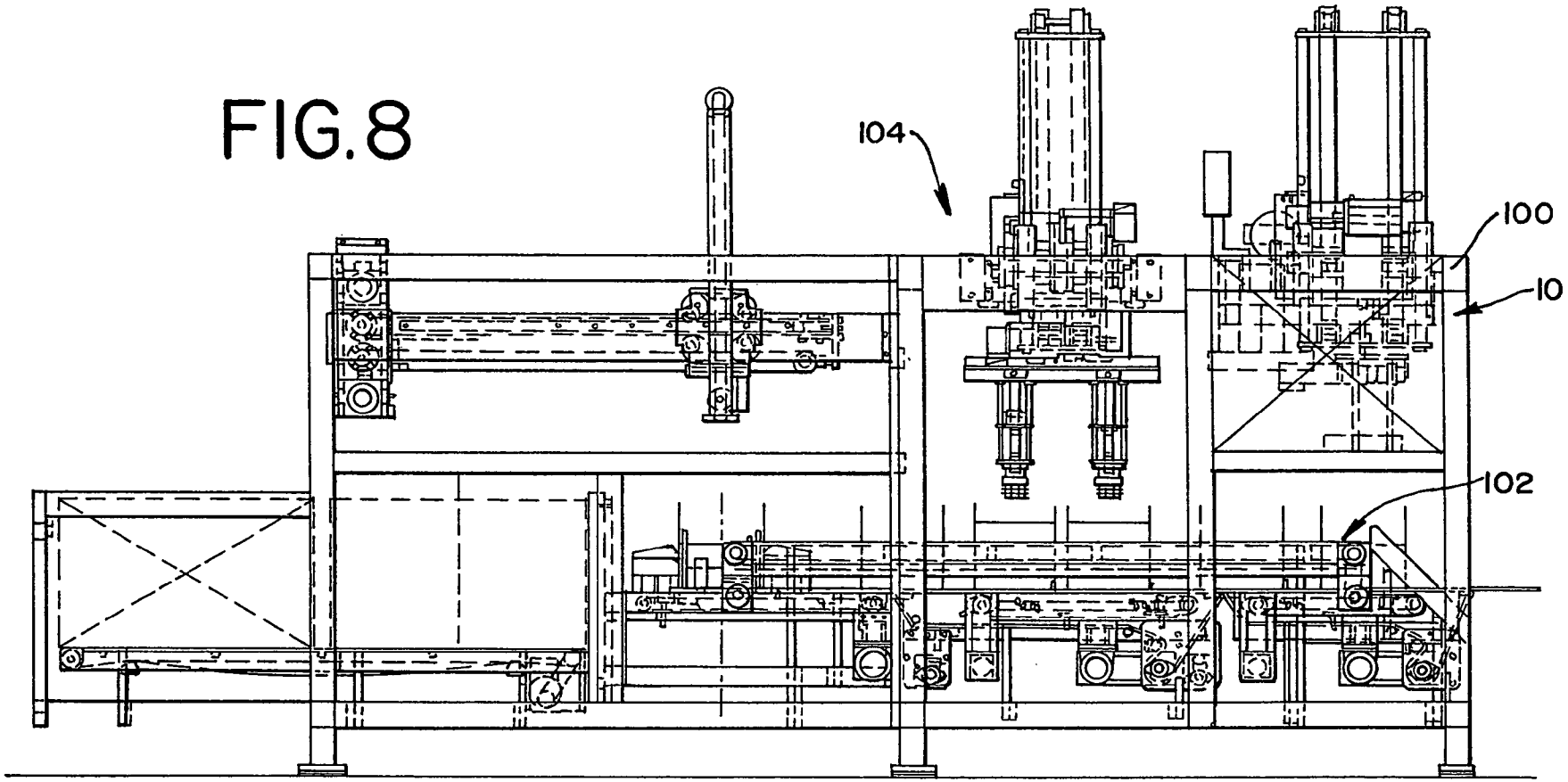
Figure 9:
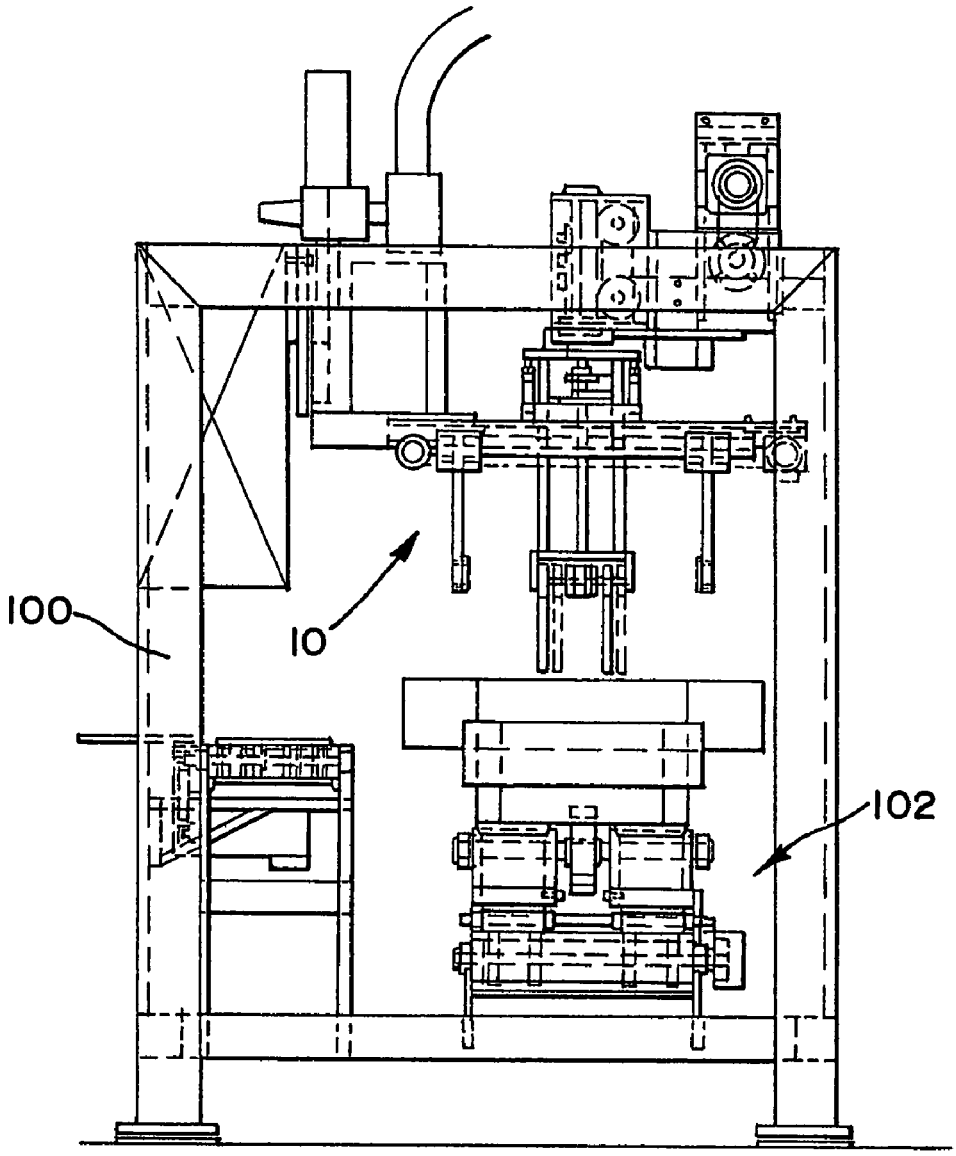

As shown in FIGS. 7-9, the present invention contemplates a suitable frame assembly 100 for receiving boxes by way of a conveyance 102 and holding all elements of the flaps closing apparatus 10. The frame assembly 100 and flaps closing apparatus 10 may be part of a unitary, integrated erecting/packing/closing system 104, or constructed so as to form a stand-alone case sealer (not shown). Other devices may be integrated into the frame assembly such as, for example, gluing, labeling, wrapping, coding, and weighing devices or other substations. In either embodiment, cartons to be closed are preferably delivered to a position directly underneath the apparatus 10 in a condition with the box top open with top flaps in an essentially vertical position and bottom flaps glued and closed. In addition, it will be understood that the various control functions are performed by a control system (not shown), which may be any suitable control system, the design and application of which is considered to be within the capabilities of one skilled in the art.

Returning to FIG. 1, the flaps closing apparatus 10 is connected to the frame by way of a main upper plate 16, adjacent an uppermost portion of the frame assembly, via apparatus lowering members 18. The apparatus lowering members 18 may be cylinders, rods or plates, or any suitable shaped members. The entire flaps closing apparatus 10 is lowered and lifted during operation by way of the lowering members 18 by a first servomotor (not shown). The first servomotor quickly and accurately positions the apparatus 10 over the box. An advantage of the servomotor is the ability to quickly change the control parameters such that the operation of the apparatus 10 can be quickly adapted to different sized boxes without changing any mechanical parts and so on.

An upper block 20 is connected to an underside of the main upper plate 16. The compression plates actuating mechanism, generally shown at 22, is connected to the upper block 20 by way of a compression plates actuating mechanism plate 24. The compression plates actuating mechanism 22 operates to produce inward and outward motion of the compression plates 26 (one of which is shown). Compression plate 26 is connected to the compression plates actuating mechanism 22 by way of a first bar support 28 attached adjacent a rear edge of the compression plate and a second bar support 30 spaced relatively behind the first edge of the compression plate. As shown more clearly in FIG. 3, the compression plates 26 are positioned relatively outwardly of the flaps closing assembly 12 and initially above the flaps closing assembly.

Continuing with FIG. 1, front and rear flap closing bars 32, 34 are positioned initially adjacent and inside of the compression plates 26. The rear flap closing bar 32 is shown in an initial position 34A and a final position 34B. It will be understood that in this position, the front bar 32 actually extends back to cross the rear bar 34 and functions to close a leading flap of the box. The position of the flap closing bars 32, 34 are shown in an initial position with respect to the compression plates 26. The initial position of the front and rear flap closing bars 32, 34 are shown pivotally crossed in a scissor-like configuration and oriented at an angle of about 35 degrees relative to horizontal. As the assembly 10 descends toward a box, the front and rear flap closing bars 32, 34, in the initial angled configuration, contact the box top flaps and urge the flaps into a similarly angled configuration. As will be explained more fully below, the bars 32, 34 are released from being rigidly held in this angled, crossed position by release of a brake (shown and explained in FIG. 3 and FIG. 6, below) and permitted to pivot into a horizontal position while driving the box flaps into a horizontal (closed) position over the top opening of the box. At this point, movement of the flaps closing assembly 12 ceases and the compression plates 26 continue to descend and move inwardly (preferably in an arcuate path), whereby end portions of the flaps are urged into contact with respective sides of the box and secured thereto.

The top ends of the first and second bar supports 28, 30 are attached to respective carriages 36 (See FIG. 2) of the compression plates actuating mechanism 22. The carriages 36 are actuated to travel inwardly from an initial relatively outward position to urge the flaps of the box to the box sides. Each carriage includes a pair of twin pillow blocks, one of which is shown at 38. Pillow blocks 38 are essentially self-lubricating bushings positioned within a block or housing and adapted to slide along a longitudinal shaft or cylinder. Each of the twin pillow blocks is disposed on and slides along a linear race, one of which is shown at 40. Linear race 40 is attached to the compression plates actuating mechanism 22 plate 24 by a respective one of first and second linear rail support plates 42 and 44. A second servomotor and gearbox 46 is provided to actuate the carriages 36 inwardly and outwardly as will be explained more fully below.

The flaps closing assembly 12 is attached to a plurality (preferably, three) of shafts 48. The shafts 48 pass through the compression plates actuating mechanism 22 and the upper block 20 and main upper plate 16. The shafts 48 pass through brake 78 adjacent shock absorber housing 50 and during movement, abuts against stop collar 52 at the end of travel. In operation, the shafts initially hang from the main upper plate 16. When the flaps assembly 12 comes into contact with and closes top flaps of the box, the compression plates continue to lower and shafts 48 travel upwardly, accommodating the movement through brake 78.

Figure 2:
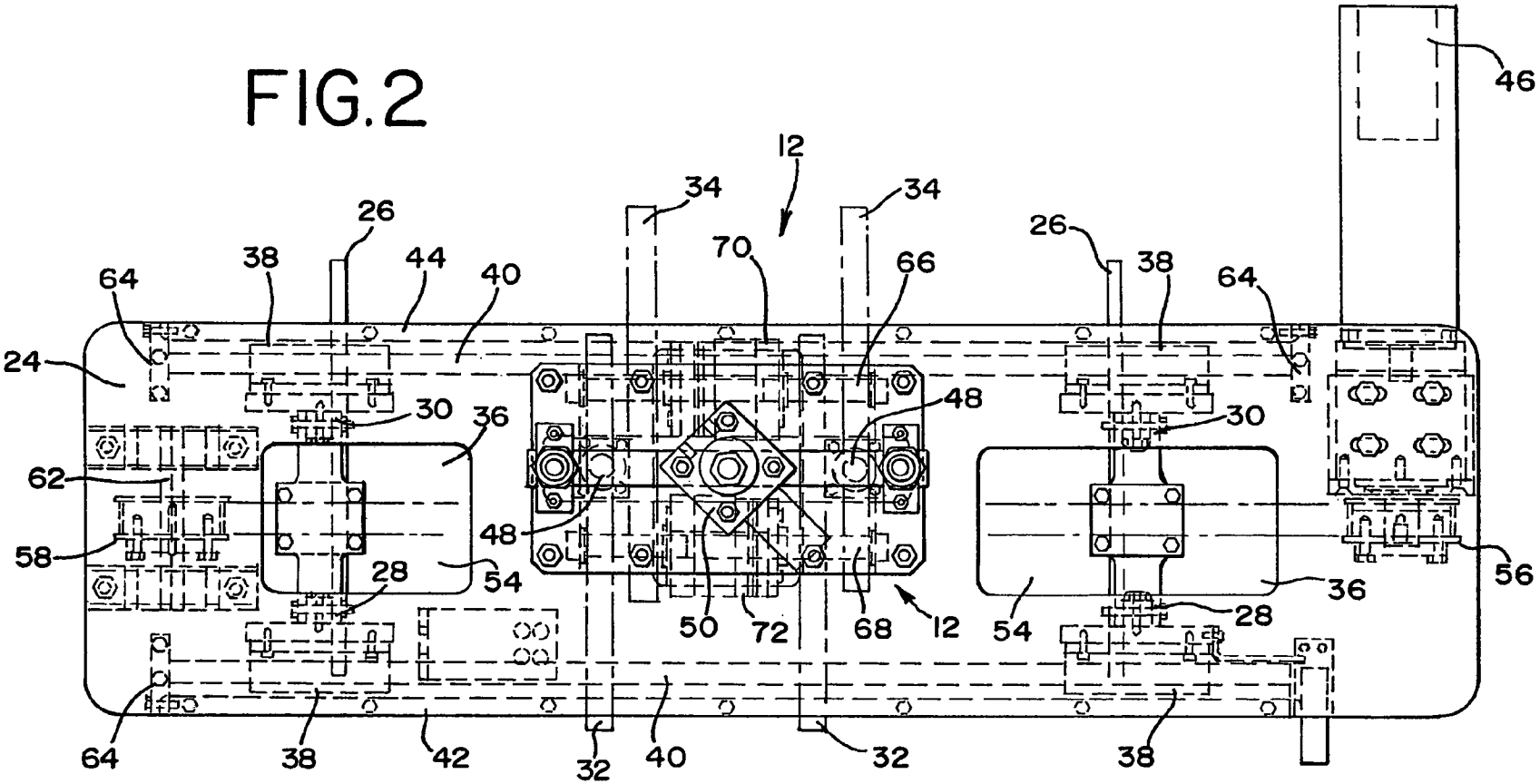
FIG. 2 is a top view of the assembly of FIG. 1.

FIG. 2 shows a top view of the present invention assembly 10 including most of the compression plates actuating mechanism 22. A pair of carriages 36 is located underneath the compression plate actuating mechanism plate 24. Each of the pair of carriages 36 includes a centrally positioned carriage body or plate 54 with the pillow blocks 38 positioned on opposite sides. Each pillow block slides horizontally on a respective linear race 40. The second servomotor and gearbox 46 is positioned at one end of the main upper plate 16 just outside of one of the carriages 36. A first pulley 56 is positioned on an end shaft of the second servomotor and gearbox 46. A second pulley 58 is disposed on a second pulley shaft 62 positioned outside of the other carriage 36 at an opposite end of the compression plate actuating mechanism plate 24. A power train member 86 such as a belt, toothed belt or chain is wrapped over and arranged about the pulleys 56, 58 and connected to the carriages 36 so as to simultaneously draw the carriages inwardly when the second servomotor and gearbox 46 is actuated in a first direction. Conversely, the carriages 36 are drawn simultaneously outwardly when the second server motor and gearbox 46 is actuated in a second direction. The power train member 86 may be attached to the carriages 36 by a belt strap 60 or other fastening mechanism. The ends of each of the linear races 40 are held to the compression plate actuating mechanism plate 24 by way of a stop plate 64 positioned at each end of the linear race and fastened to the underside of the main upper plate.

The upper block 20 is shown (see FIG. 1) fastened to an upper surface of the compression plate actuating mechanism plate 24 and a lower surface of the main upper plate 16 and positioned on the compression plate actuating mechanism plate at an essentially central location of the plate. The flaps closing assembly 12 is shown in a broken line underneath the upper block 20 and illustrates the relative positioning, from an upper view, of the pair of front and rear closing flaps 32, 34. In addition, the three shafts 48 supporting the flaps closing mechanism 12 are shown in parallel configuration, a central one of which is shown passing through brake 78. As will be shown in more detail below, the flaps closing assembly flaps 32, 34 are shown in position on first and second flap shafts 66, 68 each of which is actuated by respective first and second brakes 70, 72. Each brake 70, 72 may be controlled (by a pneumatic system or other suitable mechanism, not shown) in such a fashion so as to permit or restrict the movement of the flaps during flap closing as described above.

Figure 3:
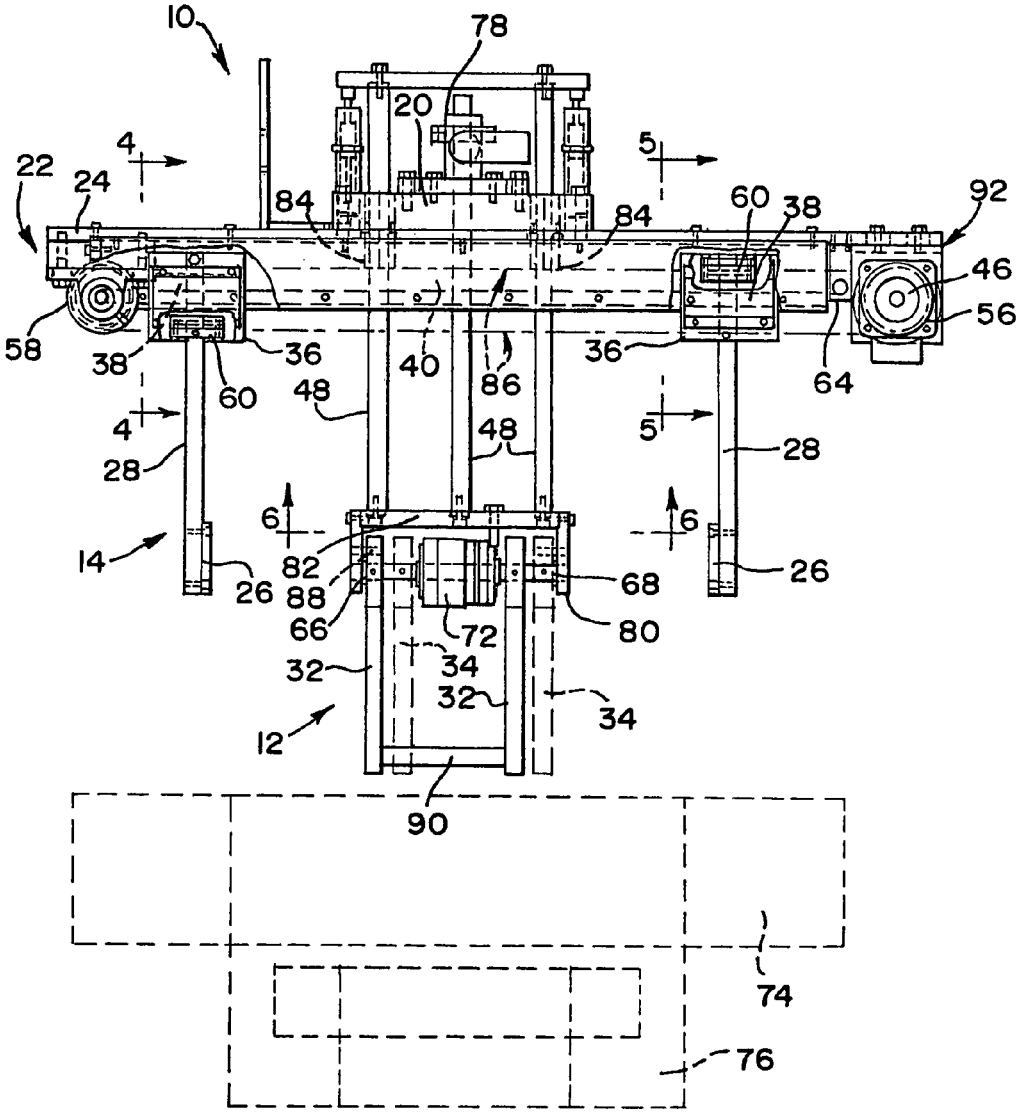
FIG. 3 is a rear view of the assembly of FIG. 1.

FIG. 3 shows a rear view of the flaps closing apparatus 10 of the present invention. The flaps closing assembly 12, in an initial position, is held above the flaps 74 of the full flap box 76. Flaps closing assembly 12 includes first closing flaps 32 and second flaps closing flaps 34 attached to first flap shaft 66 and rear flap shaft 68 respectively. First brake 70 is shown attached to first flap shaft 66. Stop pin 88 is provided to limit the range of motion of flaps 32, 34. A pair of cross bars 90 (one shown) ties and stiffens each pair of flaps 32, 34.

In operation of the device, the first brake 70 inhibits movement of the first closing flaps 32 until box flaps 74 are moved into position approximately parallel with the closing flaps 32, 34. At that point, the brakes 70, 72 are released and front and rear closing flaps 32, 34 are permitted to rotate into a horizontal position as the assembly 10 continues to descend in the direction of the box 76.

The shafts 66, 68 are attached to side plates 80, which are connected to the shaft support plate 82. Shafts 48 are connected to shaft support plate 82, slidably extend through the plate bushings 84, and are connected to a rod lock cylinder of brake 78.

Compression plates actuating mechanism 22 includes a pair of carriages 36, each having pair of pillow blocks 38, each slidably mounted to a linear race 40. Motor mount bracket 92 supports the second servomotor and gearbox 46 at one end of the plate 24. Stop blocks or plate 64 support the ends of linear race 40. The first pulley 56 is shown at the end of the gearbox 46 in the second pulley 58 is shown at an opposite end of the compression plates actuating mechanism 22. Connected to the each carriage 36 are the first bar support 28 and second bar support 30 (see FIG. 1). Each combination of first bar support 28 and second bar support 30 carries a single compression plate 26. The carriages 36 draw the compression plates 26 inwardly and outwardly in a horizontal direction. By lowering the assembly at the same time that the compression plates 26 are drawn inwardly, the motion of the compression plates can be angled in a linear fashion or in the alternate, by the controlling the rate of horizontal motion with respect to the vertical motion, the compression plates can be moved in an arcuate fashion.

Figure 4:
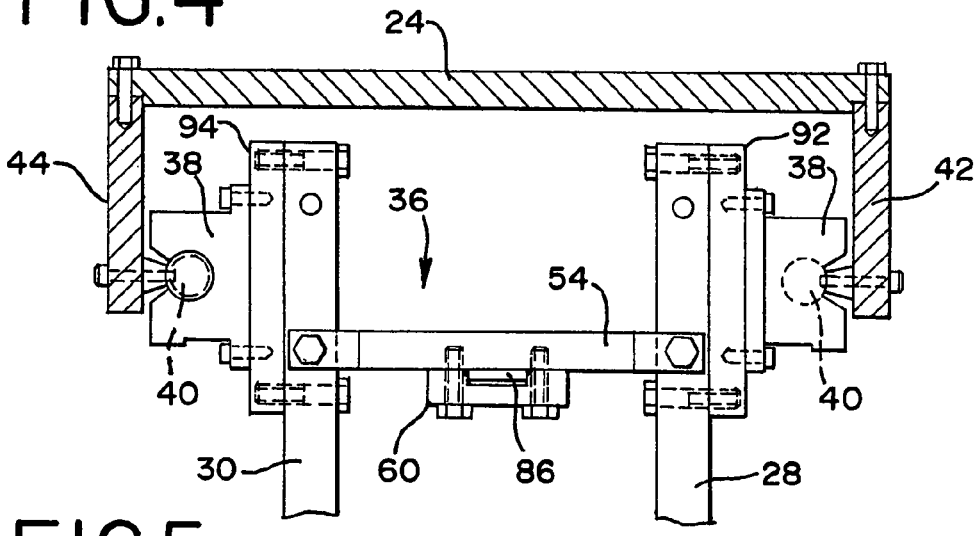
FIG. 4 is a cross-sectional view of the assembly shown in FIG. 3 through 4-4.

FIG. 4 is a cross-sectional view of the assembly shown in FIG. 3 through line 44, and shows an embodiment of a carriage 36 according to the present invention. The central carriage plate 54 includes first and rear linear rail support blocks 42, 44. Each linear rail support block 42, 44 supports a respective first and second linear race 40. Slidably disposed about each linear race 40 is a respective twin pillow block 38, which is attached to a respective first and second pillow block plate 92, 94. Each second pillow block plate 94 is connected to either a first bar support or a second bar support 28, 30. A clamping device commonly referred to as a belt strap 60 is provided to attach each carriage 36 to a suitable belt member 86 for providing motion to the carriages.

Figure 5:
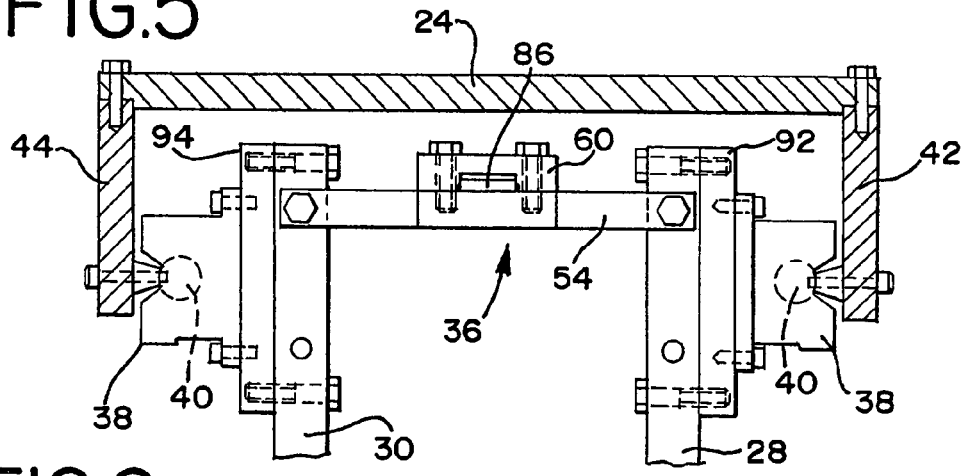
FIG. 5 is a cross-sectional view of the assembly shown in FIG. 3 through 5-5.

FIG. 5 is a cross-sectional view of the assembly shown in FIG. 3 through line 5-5, and shows another embodiment of a carriage 36 according to the present invention. This embodiment is exactly the same as the carriage 36 shown in FIG. 4 except that the central carriage plate 54 extends between the pillow block plates 92 relatively higher than the carriage shown in FIG. 4. In fact, the belt strap 60 of the carriage 36 in FIG. 5 is positioned on an upper surface of the central plate 54 whereas the belt strap 60 of the carriage 36 in FIG. 4 is positioned on a lower surface of the relatively lower central plate 54. This is because the path of the belt 86 as it is wrapped around the first and second pulley assumes an open oval path. A first carriage 36 is connected to an upper span of the oval path and a second carriage is connected to a relatively lower span of the oval path of the belt 86. By advancing the belt in one direction, one span of the belt goes a first direction at the same time the other span of the belt goes the opposite direction. In this manner, the carriages travel a first direction when the belt is advanced a first direction, and the carriages reverse direction when the belt is advanced in a second direction, the second being opposite the first.

Figure 6:
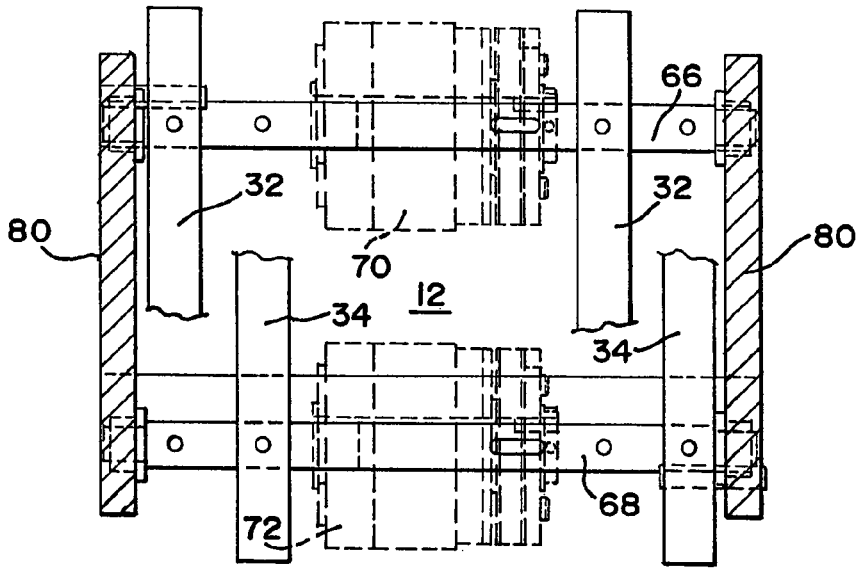
FIG. 6 is a cross-sectional view of the assembly shown in FIG. 3 through 6-6.

FIG. 6 is a cross-sectional view of the assembly shown in FIG. 3 through line 6-6. This figure illustrates the lowermost part of the flaps closing assembly 12. In particular, each of the first and second flap shafts 66, 68 has a brake mechanism 70, 72 to control movement of each of the flaps mounted to the shaft.

Figure 10:
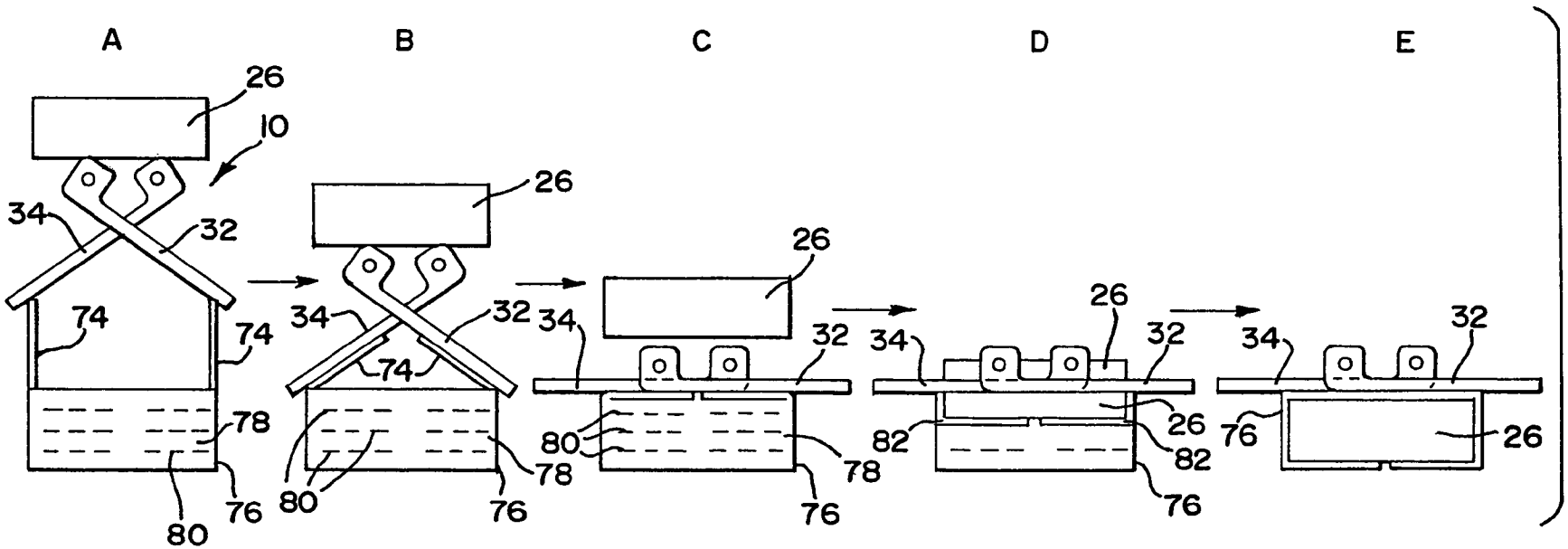
FIG. 10 is a diagrammatic representation of the operation of an embodiment of the device according to the present invention.

Turning to FIG. 10, and referring to all of the relevant figures, the operation of the apparatus of the present invention are shown in stages A-E. At stage A brakes 70, 72 and 78 are applied. A box 76 is brought into position beneath the flap closing apparatus 10 with the flaps 74 of the box in a vertical (open) position underneath bars 32, 34. Preferably, the entire apparatus 10 is lowered toward the box flaps 74 by a servo mechanism (not shown). Glue 80 is applied at or before stage A. Alternately, the box 76 is raised into operative proximity to the apparatus 10.

During stage B, the flaps closing bars 32, 34 contact the box flaps 74 and cause the box flaps 74 to assume a more lowered position from the vertical. The brake mechanisms 70, 72 are released; brake 78 is maintained applied and as the box 76 becomes fully closed, the box flaps 74 become horizontal (Stage C) as well as the flaps closing bars 32, 34. The flaps closing assembly 12 ceases downward motion by release of a second brake mechanism 78 associated with the flaps closing assembly 12 and the shafts 48 are permitted to slip upwardly while the compression plate actuating mechanism portion 22 of the apparatus 10 continues downward motion with the compression plates.

During stage D, the second motor 46 actuates the carriages 36 to impart inward motion to the bars 28, 30 carrying the compression plates 26. This command is given by sensing the position of the vertical motion servo motor. During stage E, the ends of the box flaps 82 are brought into contact with the box sides 78 to seal the box.

The described embodiments are to be considered in all respects only as illustrative and not restrictive, and the scope of the invention is, therefore, indicated by the appended claims rather than by the foregoing description. Those of skill in the art will recognize changes, substitutions and other modifications that will nonetheless come within the scope of the invention and range of the claims.

What is claimed is:

1. A flaps closing apparatus for closing boxes comprising:

a flaps closing assembly operatively associated with a first brake mechanism, said flaps closing assembly further including one or more pairs of closing bars operatively associated with a second brake mechanism;

said first brake mechanism being adapted to control the vertical motion of said flaps closing assembly with respect to said flaps closing apparatus;

said second brake mechanism being adapted to hold each of said one or more pairs of closing bars in an angled configuration, and at a first predetermined vertical position permitting said one or more pairs of closing bars to pivot to a horizontal configuration;

wherein said first brake mechanism is pneumatically controlled and said second brake mechanism is pneumatically controlled;

a vertical movement mechanism adapted to bring said flaps closing apparatus into operative proximity to the box; and a flaps sealing assembly including a pair of compression plates positioned outside said flaps closing assembly and a compression plate actuating mechanism adapted to draw said pair of compression plates inwardly to urge side flaps of each of the boxes into contact with sides of each of the boxes at a second predetermined vertical position.

2. The flaps closing apparatus of claim 1, wherein said boxes are full flap boxes.

3. The flaps closing apparatus of claim 1, wherein said one or more pairs of closing bars is one pair of closing bars.

4. The flaps closing apparatus of claim 1, wherein said one or more pairs of closing bars is two pairs of closing bars.

5. The flaps closing apparatus of claim 1 where said second predetermined vertical position follows after said flaps closing assembly contacts flaps of the boxes.

6. A flaps closing apparatus for closing boxes comprising:

a flaps closing assembly operatively associated with a first brake mechanism, said flaps closing assembly further including one or more pairs of closing bars operatively associated with a second brake mechanism;

said first brake mechanism being adapted to control the vertical motion of said flaps closing assembly with respect to said flaps closing apparatus;

said second brake mechanism being adapted to hold each of said one or more pairs of closing bars in an angled configuration, and at a first predetermined vertical position permitting said one or more pairs of closing bars to pivot to a horizontal configuration;

wherein said first brake mechanism is electrically controlled and said second brake mechanism is electrically controlled;

a vertical movement mechanism adapted to bring said flaps closing apparatus into operative proximity to the box; and a flaps sealing assembly including a pair of compression plates positioned outside said flaps closing assembly and a compression plate actuating mechanism adapted to draw said pair of compression plates inwardly to urge side flags of each of the boxes into contact with sides of each of the boxes at a second predetermined vertical position.

7. The flaps closing apparatus of claim 1, wherein said boxes are full flap boxes.

8. The flaps closing apparatus of claim 1, wherein said one or more pairs of closing bars is one pair of closing bars.

9. The flaps closing apparatus of claim 1, wherein said one or more pairs of closing bars is two pairs of closing bars.

10. The flaps closing apparatus of claim 1 where said second predetermined vertical position follows after said flaps closing assembly contacts flaps of the boxes.

* * * * *

UNITED STATES PATENT AND TRADEMARK OFFICE

CERTIFICATE OF CORRECTION

PATENT NO. : 7,571,587 B2
APPLICATION NO. : 11/803302
DATED : August 11, 2009
INVENTOR(S) : Goodman It is certified that error appears in the above-identified patent and that said Letters Patent is hereby corrected as shown below:

Claim 6, Col. 8, ln. 44, delete "flags", insert --flaps--.

Signed and Sealed this

Twenty-second Day of December, 2009

David J. Kappos

David J. Kappos
*Director of the United States Patent and Trademark Office*